US005171923A

United States Patent [19]

Dickson et al.

[11] Patent Number: 5,171,923

[45] Date of Patent: Dec. 15, 1992

[54] RECYCLE FOR PROCESS FOR PURIFICATION OF LINEAR PARAFFINS

[75] Inventors: Charles T. Dickson, Houston; Janet R. Fitzke, LaPorte; Christopher L. Becker, Seabrook, all of Tex.

[73] Assignee: Exxon Chemical Patents Inc., Linden, N.J.

[21] Appl. No.: 601,345

[22] Filed: Oct. 23, 1990

Related U.S. Application Data

[63] Continuation-in-part of Ser. No. 238,854, Aug. 31, 1988.

[51] Int. Cl.[5] ..... C7C 7/12

[52] U.S. Cl. ..... 585/821; 208/310 R; 208/310 Z; 585/823; 585/824; 585/826; 585/827

[58] Field of Search ..... 208/310 R, 310 Z; 585/821, 823, 824, 826, 827

[56] References Cited

U.S. PATENT DOCUMENTS

| | | | |
|---|---|---|---|
| 2,881,862 | 4/1959 | Fleck et al. | 585/827 |
| 2,950,336 | 8/1960 | Kimberlin, Jr. et al. | 585/827 |
| 2,978,407 | 4/1961 | Tuttle et al. | 585/827 |
| 3,063,934 | 11/1962 | Epperly et al. | 585/402 |
| 3,182,014 | 5/1965 | Seelig et al. | 585/823 |
| 3,228,995 | 1/1966 | Epperly et al. | 260/676 |
| 3,278,422 | 10/1966 | Epperly et al. | 585/827 |
| 3,393,149 | 7/1968 | Conley et al. | 210/42 |
| 3,558,732 | 1/1971 | Neuzil et al. | 260/674 |
| 4,313,014 | 1/1982 | Kondo et al. | 585/827 |
| 4,337,156 | 6/1982 | Derosset | 208/310 Z |
| 4,567,312 | 1/1986 | Miller et al. | 585/419 |
| 4,567,315 | 1/1986 | Owaysi et al. | 585/827 |
| 4,571,441 | 2/1986 | Miwa et al. | 585/820 |
| 4,581,134 | 4/1986 | Richter, Jr. et al. | 210/96.1 |
| 4,795,545 | 1/1989 | Schmidt | 208/310 Z |

FOREIGN PATENT DOCUMENTS

| | | |
|---|---|---|
| 0164905 | 12/1985 | European Pat. Off. . |
| 2095861 | 1/1972 | France . |
| 1298202 | 3/1987 | U.S.S.R. . |
| 827433 | 2/1960 | United Kingdom . |

*Primary Examiner*—Curtis R. Davis
*Assistant Examiner*—William C. Diemler
*Attorney, Agent, or Firm*—Edward F. Sherer

[57] ABSTRACT

A process for purifying linear paraffins in which a hydrocarbon feedstream containing linear paraffins contaminated with aromatics, sulfur-, nitrogen-, and oxygen-containing compounds, and color bodies, and also containing up to about 5 wt % desorbent from effluent recycle, is contacted with a solid adsorbent such as a NaX zeolite or zeolite MgY; after adsorption the adsorbent is desorbed with an alkyl-substituted aromatic desorbent, such as toluene. As the adsorent bed is being desorbed, the initial effluent from the adsorption cycle will contain levels of desorbent and may be recycled to the hydrocarbon feedstream. Previous to the removal of impurities from the adsorbent by desorption, the desorbent displaces interstitial linear paraffins which are also recycled to the hydrocarbon feedstream.

17 Claims, 1 Drawing Sheet

RECYCLE FOR PROCESS FOR PURIFICATION OF LINEAR PARAFFINS

RELATED APPLICATION

This application is a continuation-in-part application of commonly owned, co-pending patent application U.S. Ser. No. 07/238,854 filed Aug. 31, 1988 entitled "Process for the Purification of Linear Paraffins", the disclosure of which in its entirety is hereby incorporated herein by references thereto.

FIELD OF THE INVENTION

The present invention relates to a process for purifying paraffins, and more specifically it relates to processes for purifying linear paraffins. In particular, the present invention is directed to an adsorption process for the purification of linear paraffins using high levels of recycle from the adsorb cycle in the feedstream of the linear paraffin purification process. In accordance with the present invention, the feedstream supplied to the adsorbent bed may include desorbent levels of above 0.15% up to 5.0%, which are introduced to the feedstream by the recycle of an effluent stream from the adsorb cycle and/or desorb cycle of the adsorption process.

DESCRIPTION OF BACKGROUND AND RELEVANT MATERIALS

As with any hydrocarbon product whose starting point is crude oil, the degree of purity to which paraffins may be refined covers a wide range from relatively crude to relatively pure. While each grade of paraffins has commercial use, there are special applications which require a paraffin product of exceptional purity. Certain of these special applications additionally require a paraffin product whose composition is substantially limited to linear paraffins, which may alternatively be referred to as normal, unbranched, or straight-chain paraffins.

One such special application is the manufacture of detergents, in which linear paraffins may serve as the alkyl constituent of sulfonated alkylaryl-and alkyl-sulfonate synthetic detergents. Linear paraffins are preferred in such manufacture because they result in a product having superior detergent properties, which moreover has superior biogradability compared to synthetic detergents manufactured from branched paraffins.

Other important uses for substantially pure linear paraffins include as ingredients for the manufacture of flameproofing agents; as reaction diluents; as solvents; as intermediates in aromatization reactions; as plasticizers; and for use in protein/vitamin concentrates.

Unfortunately, substantially pure linear paraffins are extremely difficult to obtain. Linear paraffins intended for industrial and commercial usage are not produced by synthesis, but are instead isolated from naturally-occurring hydrocarbon sources, and most typically from the kerosene boiling range fraction of natural hydrocarbon feedstocks (as used herein, the term "kerosene range" refers to a boiling point range of between about 182°-277° C.). These feedstocks are made up of a wide variety of hydrocarbon constituents and include, in addition to paraffins, impurities such as aromatic compounds, and heteroatom compounds such as sulfur-containing compounds, nitrogen-containing compounds, and oxygen-containing compounds (i.e., phenolics).

The commercial processes used for separating out the linear paraffin component of such feedstocks are generally not sufficiently precise to yield a substantially pure linear paraffin product. Instead, the separated kerosene range linear paraffin product may contain the impurities described above in amounts sufficient to preclude use of the product for the special applications referred to earlier.

The principle prior art methods for upgrading kerosene range linear paraffins to substantially pure linear paraffins are mild hydrofining followed by acid treating, and severe hydrofining. While acid treating does remove aromatics from kerosene range linear paraffins, this is not an entirely satisfactory procedure. Acid treating addresses only the aromatics component of a contaminated paraffin stream, without improving product purity with respect to heteroatom compounds. In addition, acid treating raises significant concerns relating to health, safety, industrial hygiene, and environmental quality. Moreover, acid treating can actually increase the levels of sulfur in the final product.

As a general matter, processes are known whereby specific hydrocarbon fractions may be purified and/or isolated from a relatively crude source using solid adsorbents. In these prior art processes a bed of a solid adsorbent material is contacted with a hydrocarbon stream in either liquid or a vapor phase under conditions favorable to adsorption. During this contacting stage a minor portion of the hydrocarbon stream is adsorbed into pores in the solid adsorbent, while the major portion, which may be termed the effluent or raffinate, passes through.

Depending on the process and the product involved, the adsorbent may be used either to adsorb the desired product, which is then desorbed and recovered, or to adsorb the undesired impurities, resulting in an effluent which is the purified product.

In either event, during the contacting stage the solid adsorbent gradually becomes saturated with adsorbed material, which consequently must be periodically desorbed. If the adsorbent contains the undesired impurities, desorption is necessary in order to free the adsorbent for further removal of impurities. If the adsorbent contains the desired product, desorption both frees the adsorbent for further separation of the desired product from the hydrocarbon stream, and liberates the desired product from the adsorbent for recovery and, if desired, for further processing.

Desorption is generally accomplished by first isolating the bed of adsorbent material from the hydrocarbon stream, and then contacting the adsorbent bed with a stream of a substance which has the effect of displacing the adsorbed material from the solid adsorbent. This substance is referred to as desorbent. Once desorption is completed, the bed of solid adsorbent can again be brought into contact with the hydrocarbon stream.

The efficiency of the adsorption/desorption process is determined by several critical factors, including the precise adsorbent selected; temperature; pressure; flow rate of the hydrocarbon stream; concentrations of feedstream components; and, the desorbent.

The prior art in this area demonstrates the complexity, and the high degree of specificity, involved in matching a given feedstock, from which a given product is desired, with a suitable adsorbent/desorbent combination, under appropriate conditions to arrive at a commercially acceptable process.

FLECK et al , U.S. Pat. No. 2,881,862, discloses separating aromatic compounds and sulfur compounds from complex hydrocarbon streams through adsorption onto a "zeolitic metallo alumino silicate," which may be desorbed with linear pentane (see column 5, lines 49–54; column 6, lines 8–12).

KIMBERLIN et al., U.S. Pat. No. 2,950,336, discloses the separation of aromatic compounds and olefins from hydrocarbon mixtures that may also include paraffins, using a zeolitic molecular sieve which may be desorbed by gas purge, evacuation, displacement with an aromatic hydrocarbon, or steaming followed by dehydration (see column 4, lines 38–48).

TUTTLE et al , U.S. Pat. No. 2,978,407, discloses the separation of aromatic hydrocarbons from mixtures which include linear paraffins, isoparaffins, cyclic hydrocarbons, and aromatics, using molecular sieves having pore diameters of 13 Angstroms, which may be desorbed by gas purge and/or evacuation (see column 2, lines 65–70).

EPPERLY et al., U.S. Pat. No. 3,063,934, discloses removing aromatic compounds, olefins, and sulfur from the feed to a naphtha isomerization reactor using a molecular sieve, such as a Linde 10X or a Linde 13X molecular sieve, which may then be desorbed using the effluent from the isomerization reactor (see column 2, lines 36–41).

EPPERLY et al., U.S. Pat. Nos. 3,228,995 and 3,278,422 both generally disclose the separation of aromatics and/or nonhydrocarbons from saturated hydrocarbons and/or olefins using a zeolite adsorbent. The zeolite is desorbed with a polar or polarizeable substance, which is preferably ammonia, although sulfur dioxide, carbon dioxide, alcohols, glycols, halogenated compounds, and nitrated compounds may be used.

KONDO et al., U.S. Pat. No. 4,313,014, discloses the adsorptive separation of cyclohexene from a cyclohexene/cyclohexane mixture using a type X and/or type Y aluminosilicate zeolite, which may be desorbed with a trimethylbenzene (see column 2, lines 3–11).

OWAYSI et al., U.S. Pat. No. 4,567,315, discloses a process for removing aromatic hydrocarbons from a liquid paraffin. The aromatics are first adsorbed by a type X zeolite molecular sieve material, and are then desorbed using a polar or polarizeable substance such as an alcohol or glycol (see column 3, lines 65–68 and column 7, lines 15–20). In a third step the desorbed aromatic hydrocarbons are washed from the zeolite bed using a solvent such as n-hexane, n-heptane, or isooctane (see column 7, lines 26–30). MIWA et al., U.S. Pat. No. 4,571,441, discloses separating a substituted benzene from a substituted benzene isomer mixture using a faujasite-type zeolitic adsorbent such as type X zeolite or type Y zeolite. Depending on the nature of the substituted benzene whose recovery is desired, the desorbent used may be toluene, xylene, dichlorotoluene, chloroxylene, or trimethylbenzene; an oxygen-containing substance such as an alcohol or a ketone; or, diethylbenzene (see column 3, lines 35–59).

Russian Patent 1,298,202 discloses a method for removing aromatics from a paraffin feedstock using a solid adsorbent such as silica gel, amorphous aluminosilicate, or faujasite-type zeolite. A bed of the solid adsorbent is first pretreated with a stream of purified paraffins obtained from a prior purification cycle. The paraffin feedstock is then passed through the bed of solid adsorbent to remove aromatics therefrom until the aromatic content of the effluent reaches a specified level. Desorption of the adsorbed aromatics is carried out at 50°–500° C. using steam, ammonia, isopropyl alcohol, acetone, toluene, or the like. The desorbent must then be removed from the solid absorbent using a gas purge at 200°–500° C., and the bed must consequently be cooled to between 20°–150° C., using either a stream of purified paraffins or a gas, before resuming the adsorption phase.

Commonly owned, co-pending patent application U.S. Ser. No. 07/238,854 filed Aug. 31, 1988 entitled "Process for the Purification of Linear Paraffins" is directed to a to a process for purifying a hydrocarbon feedstock which contains linear paraffins, and at least one impurity selected from the group consisting of aromatic compounds, nitrogen-containing compounds, sulfur-containing compounds, oxygen-containing compounds, color bodies, and mixtures thereof which involves a) contacting a liquid feedstream of the hydrocarbon feedstock with an adsorbent comprising a zeolite having an average pore size of from about 6 to about 15 Angstroms under conditions suitable for the adsorption of the at least one impurity by the zeolite to produce an impurity-loaded zeolite; and b) desorbing the impurity-loaded zeolite using a desorbent comprising an alkyl-substituted benzene.

SUMMARY OF THE INVENTION

In general, the present invention is directed to an adsorption process for purification of linear paraffins, wherein the feedstream of hydrocarbon feedstock contains components of recycle effluent streams, i.e., adsorption effluent and/or desorption effluent streams, including desorbent materials.

In accordance with the present invention, these effluent streams are recycled to the feedstream so as to introduce their components including desorbent, which is selected from a class of molecules similar to the impurities, e.g. aromatics, being removed from the feedstock by the adsorption process, to fresh or raw paraffin feedstock in amounts up to about 5 wt % and, preferably in the range of 0.15%–3%, and most preferably at a level of about 1.5%.

The present invention is based on the discovery that the level of such desorbent material which may be present in the hydrocarbon feedstock to be purified is such that over about 80% of interstitial paraffins which are present in the adsorbent bed after the absorb cycle, described in more detail herein below, may be recovered by recycling the interstitial paraffins, which are displaced by desorbent, to the feedstream of hydrocarbon feedstock.

It has also been discovered that the effluent from the adsorbent bed, which contains such desorbent material from a complete adsorption cycle, described in more detail herein below, may be recycled to the feedstream of hydrocarbon feedstock, and that the resultant purified hydrocarbon feedstock product, which may contain desorbent materials at levels within the range of about 1–5%, may be recycled to the feedstream of feedstock.

More specifically, the present invention is directed to a process for purifying a hydrocarbon feedstock which contains linear paraffins and at least one impurity selected from the group consisting of aromatic compounds, nitrogen-containing compounds, sulfur-containing compounds, oxygen-containing compounds, color bodies, and mixtures thereof, which involves the steps of contacting a liquid feedstream, including hydrocarbon feedstock, at least one impurity, and a material suitable for use as a desorbent for the at least one impurity, with an adsorbent under conditions suitable for adsorption of the at least one impurity by the adsorbent to produce an impurity-loaded adsorbent and an adsorption effluent stream; desorbing the impurity-loaded adsorbent using a desorbent composed of an alkyl-substituted benzene to result in a desorption effluent stream including the hydrocarbon feedstock and the desorbent; and recycling at least one effluent stream selected from the group consisting of the adsorption effluent stream and the desorption effluent stream to the liquid feedstream until the liquid feedstream contains an amount up to about 5% of the desorbent. The amount of the desorbent in the liquid feedstream may fall within the range of about 0.01% to about 3.0%, and preferably within the range of about 0.1% to about 1.5%, i.e., within a range of about 0.1% to about 0.4%, and more preferably within the range of about 0.1% to about 0.3%, and more preferably is about 0.15%.

DETAILED DESCRIPTION

Figure 1:
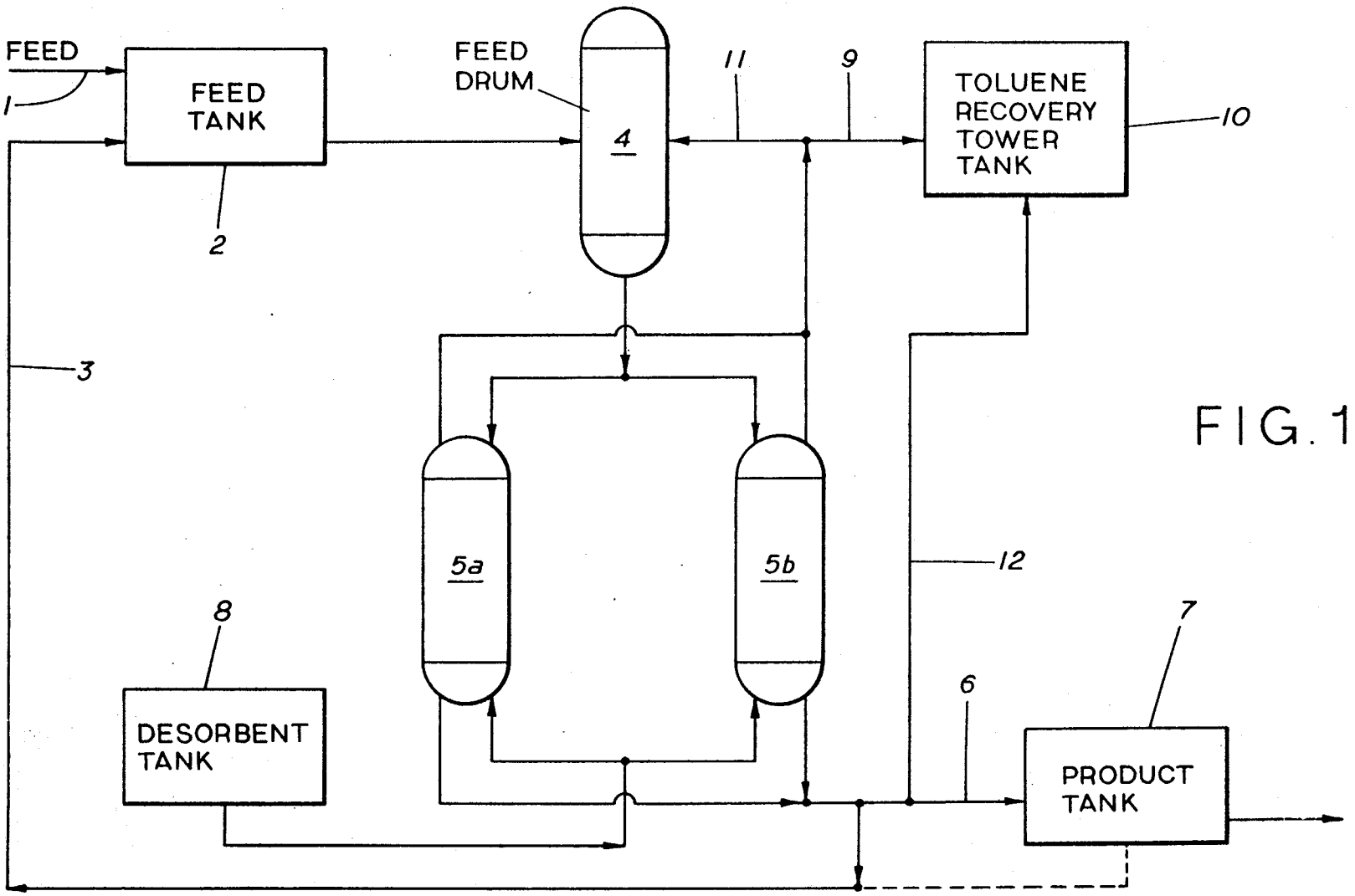
FIG. 1 is a flow chart showing to the process for purification of linear paraffins in accordance with the present invention.

The feedstock used to form the hydrocarbon feedstream to be purified according to the process of the present invention may be any hydrocarbon fraction which includes linear paraffins contaminated with aromatic and/or heteroatom compounds. Typically, the paraffins present in the feedstream have a carbon chain length of $C_8$–$C_{22}$.

In accordance with the present invention, however, the feedstock may contain substantially greater amounts of desorbent, such as an alkyl-substituted benzene, e.g., toluene, for example, as a result of desorbent being recycled from the adsorption cycle, in addition to the contaminants and impurities identified and described in more detail hereinbelow, than heretofore was thought to be possible. The present invention is based on the discovery that high levels of desorbent may be tolerated in the feedstock if a desorbent is selected from a group of a class of molecules, similar to the impurities which are present in the feedstock, and preferably aromatics which has been discovered to be a predominant impurity in such feedstocks.

The aromatics may be present in the hydrocarbon stream in an amount of from about 0.1 to about 10.0 weight percent, and are typically present in an amount of from about 0.5 to about 3.0 percent.

Typical aromatic compounds present in the feedstock include monocyclic aromatics, such as alkyl-substituted benzenes, tetralins, alkyl-substituted tetralins, indanes, and alkyl-substituted indanes; indanes and naphthalenes; and bicyclic aromatics, such as naphthalenes, biphenyls, and acenaphthenes.

It will be understood by those of ordinary skill in the art, however, that feedstocks which may be treated by the process according to the present invention will contain an extremely diverse array of other impurities, composed principally of oxygen-, sulfur-, and nitrogen-containing compounds, as well as color bodies.

The feedstock may contain oxygen-containing compounds, i.e., heteroatom-containing compounds. The most common oxygen- containing compounds found in the feedstock are phenolics, which may be present in the hydrocarbon feedstock at a concentration of up to about 600 wppm, and preferably up to about 300 ppm. Typically, phenolics are present in the feedstock at a concentration of between about 10 wppm and 150 wppm, and more typically within the range of about 10 wppm and about 100 wppm.

The amount of sulfur-containing compounds in the hydrocarbon feedstock may be as high as about 20 wppm. Typically the sulfur content is between about 1 and 15 wppm. Typical sulfur-containing compounds present in the feedstock include sulfides, thiophenes, and mercaptans, and mixtures thereof. Mercaptans may be present in amounts of up to about 1 wppm.

Nitrogen-containing compounds may be present in the hydrocarbon feedstock at a concentration of up to about 500 wppm. More typically, the concentration of nitrogen-containing compounds is between about 1.0 and 200 wppm. Typical nitrogen-containing compounds present in the feedstock include indoles, quinolines, and pyridines, and mixtures thereof.

In addition to the above impurities, the feedstock to be purified according to the present invention may include color bodies. The Pt/Co color of the feedstock may be as high as about 30, measured by ASTM D-1209, and is typically between about 5 and 20.

Although the representative categories of these impurities are described above, however, the specific enumeration of these categories herein is illustrative only, and should not be considered as either limiting or exhaustive.

One feedstock suitable for use in the process according to the present invention is the linear paraffin product from a process for separating linear paraffins from a kerosene-range hydrocarbon fraction. The linear paraffin effluent from such a process will typically consist principally of linear paraffins which, due to the nature of the crude stock from which they were isolated, will be contaminated with aromatics as well as with heteroatom compounds.

In accordance with the present invention, the feedstock, i.e., a hydrocarbon feedstream, is preferably contacted in a liquid phase with a solid adsorbent. Before being contacted with the absorbent the feed is heated to a temperature of from about 20° C. to about 250° C.; the preferred temperature range for carrying out absorption is from about 100° C. to about 150° C. Back pressure regulation can be used to ensure maintenance of the liquid phase.

The flow rate of the hydrocarbon feedstream through the solid adsorbent is adjusted to range from about 0.2 WHSV to about 2.5 WHSV, with the preferred range being from about 0.75 WHSV to about 2.0 WHSV.

The desorbent is likewise contacted with the solid adsorbent in the liquid phase. The desorbent may also be heated to a temperature from about 20° C. to about 250° C. before being contacted with the adsorbent, with the preferred temperature range being substantially the same as the temperature at which the feedstream is contacted with the adsorbent.

The flow rate of the desorbent through the solid adsorbent may vary at least from about 0.1 WHSV to about 2.5 WHSV, preferably within the range of about 0.2 WHSV to about 2.5 WHSV and more preferably is from about 0.3 WHSV to about 1.5 WHSV.

The solid adsorbent used in the process according to the present invention may be any molecular sieve. It is preferred to use zeolites of the of the faujasite family, which includes natural and synthetic zeolites having an average having an average pore diameter of from about 6 to about 15 Angstroms. Representative examples of molecular sieves include faujasites, mordenites, and zeolite types X, Y, and A. The zeolites most preferred for use in the process according to the present invention are zeolite types X and Y.

The zeolite more preferably has a pore size of between about 6.8 and about 9 Angstroms, and may be substantially in the form of crushed or beaded particles.

In one particular embodiment, the zeolite may be a type Y zeolite, and more specifically may be a cation-exchanged type Y zeolite. The cations may be selected from the group consisting of alkali and alkaline earth metals.

In a particularly preferred embodiment, the cation-exchanged type Y zeolite is MgY zeolite.

The zeolite may alternatively be a type X zeolite, such as NaX zeolite.

The adsorbent used in the process according to the present invention may include an inorganic binder such as silica, alumina, silica-alumina, kaolin, or attapulgite.

The zeolites may be subjected to cation exchange prior to use. Cations which may be incorporated into the zeolites, through ion-exchange processes or otherwise, include all alkali and alkaline earth metals, as well as trivalent cations, with Na, Li, and Mg being preferred.

The most preferred zeolites for use in the process according to the present invention are NaX zeolite, commonly referred to as 13× zeolite, and MgY zeolite.

While the zeolite may be used in any form, it is preferred to use zeolite in the form of beaded or crushed particles, rather than extruded particles. The zeolite may be used neat, or in association with known binders including, but not limited to, silica, alumina, aluminosilicates, or clays such as kaolin and attapulgite.

In a preferred embodiment of the process according to the present invention, the adsorption and desorption cycles or phases are conducted counter-current to each other. Specifically, adsorption is effected by contacting the hydrocarbon feedstock with the bed of solid adsorbent in downflow fashion; and adsorption is conducted in an upflow direction.

Referring now to FIG. 1, the feed 1 of a hydrocarbon feedstock to be purified is introduced into feed tank 2 into which recycled product stream 3, which has been recycled from product tank 7, may also be introduced. From the feed tank 2, the liquid feedstream of the hydrocarbon feedstock, which contains at least one impurity selected from the group consisting of aromatic compounds, nitrogen-containing compounds, sulfur-containing compounds, oxygen-containing compounds, color bodies, and mixtures thereof, is fed into a feed drum 4 prior to being introduced into one of the two adsorbent beds 5*a* and 5*b*.

Typically the feedstock contains 98.0% of $C_{10}$–$C_{19}$ linear paraffins in addition to about 2.0% of aromatics in the kerosene boiling range. The adsorbent beds 5*a* and 5*b* contain 13 type X zeolite molecular sieve that has been desorbed by passing toluene over the sieve. Under normal operating conditions, as described herein, an amount of interstitial toluene would remain in the adsorbent bed when the feedstream containing the previously identified feedstock is introduced. Thus, at the beginning of the adsorption cycle, the previously identified paraffin feedstock enters the bed and volumetrically displaces the interstitial toluene which makes up the initial adsorption effluent stream that may be recycled to toluene recovery tower tank 10 via tank 7 and appropriate recycle lines. In addition, the purified linear paraffin recycle product stream 3, also contains an amount of desorbent, such as toluene, typically at levels within the range of about 1.0–5.0% and above, which may also be recycled to feedtank 2 to form a mixture with the raw hydrocarbon feedstock. The hydrocarbon feedstock containing desorbent from feed tank 2 is then passed to feed drum 4 before being supplied to the adsorbent beds 5*a* or 5*b* for processing. The recycle of purified linear paraffin product 3 would normally only be done during start-up of the linear paraffin purification process or upset instances. The adsorbent cycle effluent or adsorption effluent stream, therefore, contains the previously identified linear paraffin material, from which impurities have been removed by the adsorbent bed, as well as displaced interstitial toluene, in addition to toluene liberated from the adsorbent bed during the adsorption step. The bulk of the interstitial toluene, however, is recycled through line 12 to the toluene recovery feed tank 10.

The adsorption cycle effluent, referred to herein as adsorbent effluent stream 6, which is then passed to the product tank 7, contains purified linear paraffins, from the standpoint that impurities have been removed by being passed through the adsorbent bed, in addition to toluene, for example interstitial toluene which was displaced by the paraffin feed which is introduced into the adsorbent beds 5*a* and 5*b*. Thus, the feedstream which is ultimately supplied to feed drum 4 from feedtank 2 can contain desorbent material, for example provided by recycle product stream 3 or effluent stream 11, in addition to the liquid paraffin feedstock to be purified.

When the adsorbent bed 5*a* or 5*b* has become saturated with impurities, the adsorption cycle for that bed is terminated and the desorption cycle for that bed is initiated. In so doing, desorbent, such as toluene, is introduced in a countercurrent manner through adsorbent bed 5*a* or 5*b*, as is appropriate. The desorbent initially displaces the impurities by taking their place in the pores of the solid adsorbent with the displaced impurities 9 being passed to toluene recovery tower feed tank or impurity tank 10. Prior to the impurities being displaced from the adsorbent bed, the desorbent, i.e., toluene, displaces interstitial linear paraffin feed molecules and the resultant mixture which includes linear paraffins and toluene as desorbent effluent stream 11 is recycled to feed drum 4.

Inasmuch the adsorbent bed 5*a* or 5*b* containing solid adsorbent is substantially filled with feedstream of hydrocarbon feedstock at the end of an adsorption step, the initial desorption effluent stream from the subsequent desorption step will consist largely of residual paraffins. A particularly valuable feature of the process according to the present invention, therefore, is recovery of these paraffins by providing for a recycle of the initial desorbent effluent stream back to the feed drum 4 for further purification in accordance with the present process.

In accordance with the present invention, as described above, as the interstitial linear paraffins are displaced from the adsorbent bed and recycled via desorbent effluent stream 11 to the feed drum 4, the level of toluene increases. As a practical manner, if the desorption cycle is permitted to run long enough, the recycled desorbent effluent stream 11 would be essentially all desorbent. Thus, the amount of desorbent that can be tolerated in the feedstream of linear paraffin in the feed drum 4 dictates the length of time that the recycled desorbent effluent stream 11 can be recycled back to the feed drum at the end of the adsorbing cycle. When desorbent, i.e. toluene, begins to appear in the desorption effluent stream, the desorption effluent can then be sent to the toluene recovery tower tank 10. In accordance with the present invention, therefore, a large quantity of the paraffins that would otherwise be rejected as toluene recovery tower bottoms can be recovered, thereby resulting in an improved once-through paraffin recovery process.

The initial desorbent cycle effluent that is recycled as desorbent effluent stream 11 may include toluene in trace quantities, resulting in a concentration of toluene in the feedstream of up to about 0.22%, with a concentration range of from about 0.0001 to about 0.15% being suitable. At these levels the toluene behaves simply as another aromatic impurity in the feedstream. In accordance with the present invention, however, the desorbent cycle effluent may be recycled until the level of toluene in the hydrocarbon feedstock is as high as 5%, but preferably within the range of about 0.5–2.0%, and most preferably until the level of the desorbent is about 1.5%.

Inasmuch as the adsorbent bed 5*a* or 5*b* is substantially filled with toluene at the end of a desorption cycle, the initial effluent from the subsequent adsorbent cycle will consist largely of residual toluene. Therefore, in the process according to the present invention, this initial adsorption effluent stream is routed via toluene recovery line 12 to the toluene recovery tower tank 10, enabling the toluene therein to be recovered and recycled.

When the paraffin content of the adsorption effluent stream begins to rise, the adsorption effluent stream is routed to a holding tank (not shown), and from there is sent to a fractionation column (not shown). This has the particularly valuable effect of reducing the fractionation load to the fractionation column.

A representative example of the process in accordance with the present invention would involve charging the feed tank of the linear paraffin purification process with 6000 B/D and running the adsorbent beds on 4- hours cycles. The effluent during an adsorbent cycle is typically 1000 barrels of 3% toluene mixture with paraffins. Assuming 20,000 barrels of feed in the feed-tank, the feedstream of hydrocarbon feedstock then would be about 21,000 barrels of a 0.1429% toluene mixture with paraffins, not taking into account the toluene introduced to the feed by a recycle of interstitial paraffin during the recycle of the desorbent recycle stream.

In accordance with the present invention, therefore, the process for the purification of linear paraffins includes the use of different recycle streams, i.e., adsorbent effluent stream and desorbent effluent stream, without disrupting what is otherwise a continuous, counter current liquid phase adsorption process. In this regard, the entire adsorption cycle effluent, for example, an adsorption effluent stream including up to about 5 wt. % of desorbent, such as toluene, may be recycled back to the feedstock; however, the present invention is primarily directed to the recycle of the interstitial hydrocarbon feedstock that remains at the end of the adsorbent cycle to provide a liquid feedstream of hydrocarbon feedstock which containing up to about 3% desorbent material, such as alkyl-substituted benzene, and most preferably about 1.5% toluene.

The prior art desorption processes are typified by the use of or polarizeable substances as desorbents. In contrast, in the process according to the present invention utilizes a desorbent which is of the same class of molecules of the predominant impurity being removed by the adsorption process, i.e., a nonpolar, alkyl-substituted benzene, to desorb the impurities from the saturated adsorbent. Under the operating conditions which have been found most suitable for carrying out the process according to the present invention, the most preferred desorbent is toluene.

Thus, the process according to the present invention enables use of a desorbent, i.e., an alkyl-substituted benzene, such as toluene, which is efficient, readily available, inexpensive, easily displaced from the solid adsorbent during the subsequent desorption step, and simply separated from the product.

While the aromatic desorbent, e.g., alkyl-substituted benzene such as toluene, may be used in a mixture with other hydrocarbon having similar boiling points for example, heptane may be used with toluene, it is preferred to formulate the desorbent principally from the aromatic substituent, with toluene being the preferred aromatic. Thus, while the desorbent may include non-toluene hydrocarbons in an amount of up to about 90%, the preferred desorbent contains non-toluene hydrocarbons in an amount of between about 0.0001 and 10%. In a particularly preferred embodiment the desorbent comprises at least about 95 percent by weight toluene, with the balance of the desorbent being made up of non-toluene hydrocarbons.

The desorbent may also include dissolved moisture in relative trace amounts. Generally, dissolved water may be present in the desorbent in an amount of up to about 500 wppm, with a range of from about 50 to about 300 wppm being preferred.

Inasmuch as the desorbent displaces the impurities by taking their place in the pores of the solid adsorbent, when the regenerated adsorbent bed is placed back on line and is again contacted with the feedstream of hydrocarbon feedstock, the initial adsorption effluent stream issuing from the adsorbent bed will contain substantial amount of the desorbent which may be separated from the purified linear paraffin product by any conventional means, such as by distillation, prior to recycling the adsorbent effluent stream in accordance with the present invention, as described above. The desorbent thus separated may, if desired, be recycled to the desorption stage; water may be added to or removed from the separated desorbent to achieve the desired composition for the desorbent prior to recycle. Preferably, however, the purified paraffin product containing such desorbent may be recycled and mixed with raw hydrocarbon feedstock. Related to this, in accordance with the preferred embodiment, however, the entire adsorption cycle may be recycled to the hydrocarbon feedstock.

By means of this process, a linear paraffin product may be obtained in which the concentration of aromatic compounds has been reduced from a feedstock content of as high as about 10 percent to a product content of less than about 100 wppm, and even of less than about 50 wppm.

The present invention extends to the purified linear paraffin product produced according to the process according to the present invention. This purified linear paraffin product may have a purity of at least about 98.5 wt %, and may contain not greater than about 80 wppm aromatics, not greater than about 1 wppm nitrogen-containing compounds, not greater than about 0.1 wppm sulfur-containing compounds, and not greater than about 10 wppm oxygen-containing compounds. The amount of aromatic compounds present in the purified linear paraffin product may be not greater than about 10 wppm aromatics, and the purity of the purified linear paraffin product may be least about 99.7 wt %.

Comparable degrees of purification may be obtained with respect to sulfur- and nitrogen-containing impurities. Whereas the hydrocarbon feedstock may include up to about 20 wppm of sulfur and up to about 300 wppm of nitrogen-containing hydrocarbons, the purified product will contain less than 0.1 wppm of sulfur-containing compounds; less than 1 wppm of nitrogen-containing compounds; and, less than about 10 wppm of phenolics.

In accordance with the present invention, 95% of the linear paraffins present in the initial feedstock charged to the solid adsorbent bed are recovered in a single adsorb/desorb cycle. This recovery is accomplished by using the improved recycle techniques described herein without resort to washing, purging, heating, cooling, liquid/vapor phase changes, or other complications.

In general, the linear paraffin purification process which embodies the improved recycle techniques in accordance with according to the present invention has several major distinguishing features which impart the process with substantial advantages over the prior art. The adsorption and desorption steps may be conducted entirely in the liquid phase, at substantially constant temperatures. This eliminates the time and expense, including increased equipment stress, involved in changing over between liquid and vapor phases as in the prior art. Also, the process uses a nonpolar desorbent which is widely available, inexpensive, and easy both to displace from the solid adsorbent and to separate from the product. Use of a nonpolar desorbent additionally eliminates the need to wash, purge, or otherwise treat the solid adsorbent bed after the desorption step but before again contacting the solid adsorbent bed with the hydrocarbon feedstream. In addition, the adsorption and desorption steps are conducted countercurrent. Use of the countercurrent technique results in a more efficient use of the desorbent, and consequently also leads to improved adsorption. Related to this, the countercurrent technique to conduct the adsorption step is conducted in a downflow fashion; this eliminates the detrimental density gradient-related backmixing which can occur during upflow adsorption as the relatively dense toluene is displaced from the solid absorbent by the relatively light paraffin feedstream. Moreover, by using a lower mass velocity while conducting desorption countercurrently in an upflow fashion, bed lifting concerns can be substantially reduced. It has also been discovered that the efficiency in economy of the process according to the present invention can be significantly enhanced by the use of a switchable recycle technique for the recovery and recycle of both hydrocarbon feed and desorbent. Also a nitrogen blanket is used to conduct the entire process under oxygen-free conditions; this avoids introduction of oxygen into the hydrocarbon and desorbent streams, which could otherwise lead to oxidative degradation of the feed hydrocarbon components and consequent formation of undesirable side products.

The process according to the present invention may be more fully appreciated through an understanding of how it fits into a general overall hydrocarbon processing and refining operation, i.e., hydrocarbon refining and normal paraffin processing operation.

In an initial step a full-range kerosene hydrocarbon feedstream is processed through a linear paraffins separation process. This feedstream typically contains only a minor proportion of linear paraffins, e.g., 8–30%, with the balance of the stream being made up of iso- and cycloparaffins, aromatics, and heteroatom-containing compounds.

The partially purified linear paraffin product, which is contaminated by aromatic compounds and by heteroatom-containing compounds, then becomes the feed 1 for the process according to the present invention. The concentration of aromatics in the feed, which affects adsorption cycle length, can be measured using any suitable measurement technique, e.g. Supercritical Fluid Chromatography (SFC).

The process according to the present invention comprises two fixed adsorbent beds 5*a* and 5*b* of solid adsorbent being operated in cyclic fashion, so that one bed is undergoing adsorption while the other bed is being desorbed. Before the process is initiated the adsorbent beds are preferably blanketed with nitrogen to create an oxygen-free environment. This prevents oxygen from being introduced into the hydrocarbon stream; otherwise, oxidative degradation of the feed hydrocarbon components could occur, resulting in formation of undesirable side products.

When the adsorbent bed undergoing adsorption reaches the end of its cycle, as measured by a threshold value for aromatics concentration in the adsorption effluent, the adsorbent beds are switched. The switching may be accomplished using a programmable controller and remote-operated valves. A typical adsorption cycle will last from about 4 hours to about 17 hours but can vary considerably depending on variables such as feed rate, the concentration of aromatics in the feed, the age of the solid adsorbent, and the amount of absorbent used.

The purified linear paraffin effluent from the adsorption step or cycle containing desorbent may be recycled to feedtank 2, as previously described, or may also be sent on to a fractionation column, where light paraffins and residual toluene are removed. During fractionation the residual desorbent present in the purified paraffin effluent is removed as a liquid distillate. A mixture of light paraffins and toluene is taken off the column as a liquid sidestream, while the heavier paraffin bottoms product is sent on for separation into final products.

The contaminated toluene desorption effluent stream from the desorption step is sent to an impurity tank or a toluene recovery tower tank 10. Overhead toluene product from the toluene recovery tower tank may be heated and recycled to the solid adsorbent beds for use in the desorption step. The tower bottoms product may be cooled, and may also be recycled to the linear paraffins separation process.

Prior to entering the toluene recovery tower, the contaminated toluene may be sent to a storage tank, which can also receive recycled toluene from the fractionation column overhead, and makeup toluene may be used to replace the toluene which escapes recovery and recycle. This storage tank can be used to mix the various streams sent into it in order to provide an output stream of consistent composition. Although toluene used for desorption of the solid adsorbent beds may be recycled, because light paraffins in the $C_6$–$C_8$ range are very difficult to separate from toluene by fractionation, these paraffins will tend to build up in the recycled desorbent. Therefore, a purge is required to control the presence of light hydrocarbon component impurities in the desorbent to about 5%.

The process according to the present invention may be further appreciated by reference to the following examples which is, of course, only representative of the present invention and in no way limiting.

EXAMPLE

The following example demonstrates that the levels of impurities, such as aromatics, may be effectively reduced to low levels below 100 wppm even though the feedstock contains various levels of desorbent, i.e., toluene, in the feedstock.

| Toluene in Feed | WHSV | Temperature | Aromatic Purified Product |
|---|---|---|---|
| 0.01% | 1.8 | 250° C. | <100 |
| 0.15% | 1.0 | 250° C. | <100 |
| 0.4% | 1.8 | 250° C. | <100 |
| 1.5% | 1.0 | 250° C. | <100 |

It will be appreciated to those of ordinary skill in the art that, while the present invention has been described herein by reference to particular means, methods, and materials, the scope of the present invention is not limited thereby, and extends to any and all other means, methods, and materials suitable for practice of the present invention.

What we claim is:

1. A process for purifying a hydrocarbon feedstock which contains linear paraffins and at least one impurity selected from the group consisting of aromatic compounds, nitrogen-containing compounds, sulfur-containing compounds, oxygen-containing compounds, color bodies, and mixtures thereof, said process comprising the steps of:

a) contacting a liquid feedstream comprising hydrocarbon feedstock, at least one impurity, and a material suitable for use as a desorbent for said at least one impurity, with an adsorbent under conditions suitable for adsorption of said at least one impurity by said adsorbent to produce an impurity-loaded adsorbent and an adsorption effluent stream;

b) desorbing said impurity-loaded adsorbent using a desorbent comprising an alkyl-substituted benzene to result in a desorption effluent stream comprising said hydrocarbon feedstock and said desorbent; and c) recycling at least one effluent stream selected from the group consisting of said adsorption effluent stream and said desorption effluent stream to said liquid feedstream until said liquid feedstream comprises an amount up to about 5% of said desorbent.

2. The process as defined by claim 1, wherein said amount of said desorbent in said liquid feedstream is within the range of about 0.01% to about 3.0%.

3. The process as defined by claim 2, wherein said amount of said desorbent in said liquid feedstream is within the range of about 0.1% to about 1.5%.

4. The process as defined by claim 3, wherein said amount of said desorbent in said liquid feedstream is within the range of about 0.1% to about 0.4%.

5. The process as defined by claim 4, wherein said amount of said desorbent in said liquid feedstream is within the range of about 0.1% to about 0.3%.

6. The process as defined by claim 2, wherein said amount of desorbent in said liquid feedstream is greater than about 0.15%.

7. The process as defined by claim 6, wherein said amount of said desorbent in said liquid feedstream is about 0.4%.

8. The process as defined by claim 2, wherein said effluent stream recycled in step c) is said desorption effluent stream.

9. The process as defined by claim 2, wherein said effluent stream recycled in step c) is said adsorption effluent stream.

10. The process as defined by claim 2, wherein said desorbent comprises toluene.

11. The process as defined by claim 10, wherein said desorbent comprises at least about 95% toluene.

12. The process as defined by claim 2, wherein said at least one impurity comprise aromatic compounds, said aromatic compounds being present in said feedstream at a concentration of from about 0.1 to about 10.0 wt %.

13. The process as defined by claim 12, wherein the concentration of said aromatic compounds is from about 0.5 to about 3.0 wt %.

14. The process as defined by claim 12, wherein said aromatic compounds are selected from the group consisting of alkyl-substituted benzenes, indanes, alkyl-substituted indanes, naphthalenes, tetralins, alkyl-substituted tetralins, biphenyls, acenaphthenes, and mixtures thereof.

15. The process as defined by claim 2, wherein said adsorbent is a zeolite having a pore size is between about 6 and about 15 Angstroms.

16. The process as defined by claim 2, wherein said desorbing step b) comprises contacting said impurity-loaded adsorbent with said desorbent at a weight hourly space velocity for said desorbent of from about 0.1 to about 2.5 WHSV.

17. The process as defined by claim 16, wherein said weight hourly space velocity for said desorbent is from about 0.3 to about 1.5 WHSV.

* * * * *